US006485400B1

(12) United States Patent
Serlachius

(10) Patent No.: US 6,485,400 B1
(45) Date of Patent: Nov. 26, 2002

(54) GYMNASTIC MEANS

(76) Inventor: Jarl-Fredrik Serlachius, Kavallvägen 1 E, FIN-02700 Grankulla (FI)

( * ) Notice: Subject to any disclaimer, the term of this patent is extended or adjusted under 35 U.S.C. 154(b) by 0 days.

(21) Appl. No.: 08/687,563

(22) PCT Filed: Feb. 10, 1995

(86) PCT No.: PCT/FI95/00055

§ 371 (c)(1),
(2), (4) Date: Sep. 30, 1997

(87) PCT Pub. No.: WO95/21664

PCT Pub. Date: Aug. 17, 1995

(30) Foreign Application Priority Data

Feb. 10, 1994 (FI) ..... 940623

(51) Int. Cl.[7] ..... A63B 26/00
(52) U.S. Cl. ..... 482/142
(58) Field of Search ..... 482/96, 97, 142, 482/91, 907

(56) References Cited

U.S. PATENT DOCUMENTS 4,603,858 A 8/1986 Reehil
4,609,193 A * 9/1986 Paris et al. ..... 482/144
5,100,130 A 3/1992 Shoebrooks
5,141,482 A 8/1992 Hern
5,248,287 A * 9/1993 Nicoletti ..... 482/140
5,295,949 A * 3/1994 Hathaway ..... 482/140
5,372,566 A * 12/1994 Olschansky et al. ..... 482/140
5,472,401 A * 12/1995 Rouillard et al. ..... 482/142
5,545,114 A * 8/1996 Gvoich ..... 482/123
5,669,862 A * 9/1997 Sayman ..... 482/140
5,772,563 A * 6/1998 Lin ..... 482/140

* cited by examiner

*Primary Examiner*—Glenn E. Richman
(74) *Attorney, Agent, or Firm*—Ladas & Parry

(57) ABSTRACT

An apparatus for exercising the back and abdominal muscles, including an elongated beam and at least two spaced devices for transferring forces between the beam and its user. The preferred embodiment includes a lower crossbar for transmitting force from the beam to the user's shins or calves and a pad for transmitting force from the beam to the user's back or stomach. It also includes an upper crossbar and shoulder straps for transmitting force from the user's shoulders to the beam. An alternate embodiment includes an arcuate, laminated beam member in which the flexibility in bending is adjustable. It also includes a lower crossbar attachable to the user's ankles by means of a pair of ankle straps and an upper crossbar attachable to the shoulders with a pair of shoulder straps. When the alternate embodiment is in use, the central portion of the beam, which is preferably padded, contacts the user's back or stomach, transmitting force thereto.

24 Claims, 2 Drawing Sheets

GYMNASTIC MEANS

Figure 1:
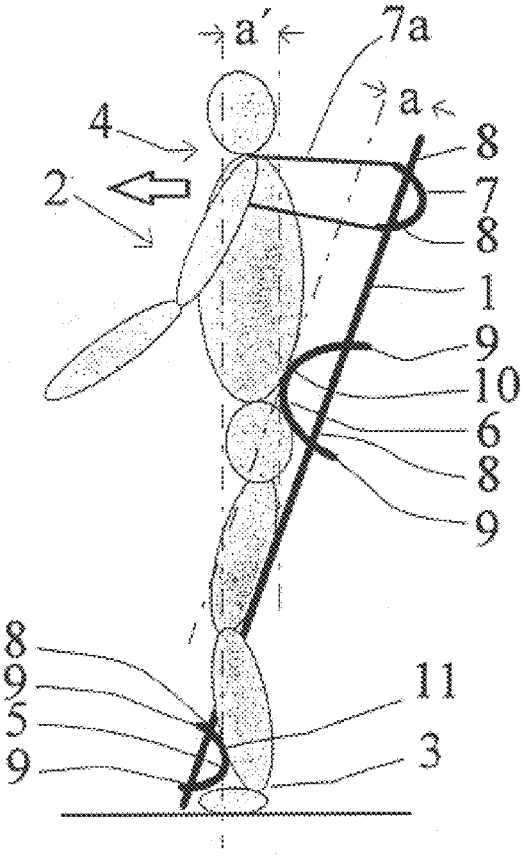

The present invention relates to a gymnastic device for the exercise of the back and abdominal musculature, said device comprising an elongated beam and means arranged at said beam for transferring the effects of a force between said device and its user.

So far no gymnastic device exists specifically intended for the abdomen and back. Devices intended for general gymnastics and strengthening of muscles have been used for the exercise of abdominal and back muscles. The device which is most common in home use comprises a disc bar, i.e. a bar provided with weights in both ends. It is not, however, possible to perform gymnastic movements which are ideal for the back and abdominal musculature with a disc bar.

Another gymnastic device intended for home use comprises a bar which is stressed in between two door posts. Moreover, rings or bars hanging in straps and intended for hanging in, are popular for home use. Consequently, there does exist several different devices but with the exception of one quite recently developed device, none of the known devices is in all respects suitable for exercising the important abdominal muscles and the situation is just as bad for the exercise of the back musculature. When considering that backache today is an extremely common disorder, it is surprising that no easily handled devices for back exercise exist.

A fairly new device comprises essentially a plastic board with handles provided at the sides thereof. The user lies down on said plastic board resting of the floor, and grips the handles and pulls himself up into a sitting position (so called sit-ups). The poorer the user's abdominal muscles are, the more he is forced to use his arms for the pulling movement. However, this device is only intended for exercising the abdominal muscles.

Despite the existence of the above mentioned devices the situation is so far such that there are no suitable ways of providing a regular exercise of the back and abdominal muscles with existing devices. On the other hand, the lack of exercise of the abdominal and back musculature forms an essential part of various kinds of physiological disorders which cause considerable losses both individually and for society.

In order to have a healthy back, the abdominal muscles should also kept be in good condition. These two muscle groups co-act and support each other. It is therefore important that a suitable gymnastic device inherently combines the possibility to exercise both important entities, i.e. both the abdominal and back muscles, with one and the same device, and it should be possible to perform this exercise at home as well as in a gym. Since backache is a very common disorder, a suitable device should be developed for home use and for quite ordinary persons.

In order to exercise the abdominal muscles and the back muscles, a person must either bend his body forward (the abdominal muscles) or slightly backwards (the back muscles). In order to increase the burden it is common especially for athletes to use weights either over the breast or at the neck. The person lies on the floor or on a bench and heaves up the upper part of his body. However, weights over the neck may cause the body to bend too much backwards at the small of the back, which usually damages the back, causing e.g. vertebral disorders. On the other hand, a forward bending will cause the weight to pull the upper part of the body downwards, which in turn will cause an incorrect burden on the small of the back. It may thus be concluded that weights over the neck tend to press the body into a crooked shape. It is therefore often considered that the weight of the body itself is sufficient. In any case, a person exercising the abdomen or the back in this way will have to lie down to perform the movements, since a bending of the upper part of the body essentially lacks effect if it is performed in an upright position. Bending the upper part of the body backward and forward can even be really dangerous if the neck is loaded at the same time.

Ordinary people who for their exercise normally need movements which strengthen the back and abdominal muscles often feel that movements which are performed lying on a floor or the like feel complicated and also often too arduous, especially in case the person's body weight is so great that it is difficult to heave the upper part of the body upwards. A common result will be that the person in question will not perform any suitable exercise at all which in the long run is very bad for the back. It is also important to have access to such devices for the exercise of the back and abdomen wherein the user of the device can perform the exercise in an upright position. Such a gymnastic device should further be simple and robust and it must not take up too much space.

The prior art patent literature disclose three devices which to some extent concern muscle exercise in an upright position. Thus, DE publication 39 15 079 relates to a device for isometric muscle exercising. Said apparatus comprises a central body having a handle-like loop means at either end. According to said patent the length of the central body may be varied, and further, the handle-like loop means may be turned in different directions. The apparatus is, however, only suitable for the performing of certain specific isometric exercises and it is not possible to perform any general constructive exercise of the back and abdominal musculature with said apparatus.

The prior art further includes U.S. Pat. No. 4,793,609 which in fact basically concerns a way of attaching a handle to an elastic beam. According to said patent the gymnastic movement at this apparatus is intended to repeatedly prolong the elastic beam by pulling at the handles. The invention described in the patent concerns an arrangement for fastening the handle to the elastic beam in such a way that the handle will not come loose during the exercise. This apparatus is not suitable for exercising the back and abdominal musculature.

The prior art further includes U.S. Pat. No. 4,925,185, as well as an earlier U.S. Pat. No. 4,834,364 concerning an essentially similar apparatus. This known gymnastic device comprises a foot plate on which the user stands. A rigid central bar is pivotally attached to said foot plate. Crossbars are arranged at said central bar on one hand at the height of the users knees and on the other hand as handles at the upper end of the apparatus. This known apparatus is used as a device for taking exercise so that the force from a muscle is transferred via said rigid central bar to act as an opposing counter force for another muscle. The essential movements which suitably can be performed with the apparatus in question are pulling with the arms on one hand, and a stretching of the thigh muscles on the other hand, said muscles being made to co-operate by the apparatus. Thus, the apparatus only has a limited utility for the exercise of the back and abdominal musculature.

The present invention provides a completely new solution to the problem of strengthening exercise of the abdominal and back musculature, and this is performed in a simple way which is well adapted to its purpose. When using the device according to the invention anybody can bend his body forward and backward standing in an upright position so that the bending takes place at the waist region. It is precisely such bending movements which are performed with the aid of the abdominal and back musculature. However, a bending movement as such without resistance has only a limited effect on the strengthening of the muscles. The device according to the present invention will now provide a possibility to add an extra resistance, which additionally may be adjusted according to the needs and capabilities of the person in question. That way the exercising movements can be utilized also as strengthening exercise.

The device according to the invention is very safe to use since it only acts in principle so as to pull the body into a straight position. This way gymnastic movements performed with the device cannot cause any damage. However, due to the fact that it is possible with the aid of the present invention to add an additional resistance, which moreover can be adjusted so as to be suitable for the person in question, it is possible for a person to exercise a his abdominal and back muscles in an ideal way and completely without risks.

The present invention is characterized by the features disclosed in the appended claims. Thus, the device suitably comprises an essentially rigid beam or body member, the rigidity of which preferably may be varied either by exchanging certain parts or through constructive details. On said body member there are arranged three suitably movable means for transferring force to the user's body such that the lowest means acts at the foot or leg, the middle one against the trunk and the upper one at the height of the shoulders at some distance from the user's body. The entire device will now make it possible to direct a suitably large. force against the shoulder parts of the user's body by taking support from the waist part and from a point at the lower part of the user's body and thus to resist a bending of his body at the waist.

Functionally the device according to the invention operates so that the user attaches his body at different points to the gymnastic device. If the beam or body member is more or less rigid a possibility for isometric gymnastics will be provided. The beam will, however, preferably be flexible to a large or small extent suitably in an adjustable way, whereby it will bend at least to some. extent under a force. The device extends longitudinally along the body from the legs to the shoulders with a support at the height of the waist. When the user now bends the upper part of his body at the waist forward or backward, the upper part of the body will act on the beam via the upper means for transferring force. For example, if the device is arranged at the back side of the user with straps around his shoulders the upper part of the body will provide a pulling of the upper part of the beam when the user bends forward. The middle means comprises a contact surface which will engage and support the small of the back. The lower means will prevent the lower part of the beam from moving freely due to its position e.g. in front of the ankle or via another fastening e.g. with straps, while the middle means take support from the waist or the small of the back. In this way the upper part of the device now will provide a resistance against the user's bending movement forward. By adjusting the flexibility of the beam this resistance can be adjusted in accordance with the user's needs.

Thus, the present invention has solved the problem connected with a gymnastic means with which the user can strengthen his back and abdominal musculature standing in an upright position, principally by utilizing a principle which is known per se from the acute therapy, i.e. that the body is "splinted" to a more or less rigid device. Each force effected by the user will be transferred to the "splint". In case of a fracture of the bone or the like the purpose has been to prevent the sections of the bone from moving in relation to each other with the aid of the splint. Normal "splints" do not, however, flex at a fair exertion of a force and could thus only be used for isometric gymnastics. As such isometric gymnastics is a useful method also for strengthening the back and abdominal musculature but it is often considered heavy and to some extent frustrating. The "splint" according to the invention is therefore arranged in such a way that, contrary to what is sought to obtain in connection e.g. with fractures, it is suitably at least slightly flexible. The "splint" according to the invention is preferably arranged in such a way that its elasticity or resistance to bending can be adapted in accordance with the user's wishes.

Since the device according to the invention consists of a beam or body member which suitably is at least slightly bendable and at least three means arranged at said beam for transferring force between said member and the user's body, a triangular force action can be formed so that one corner of the triangle can move slightly while two corners of the triangle are essentially locked at the body and prevents the whole device from twisting. Especially the upper means, which is intended for providing a force transferring contact to the user's upper body portion, will at use suitably be slightly movable, e.g., against a spring action of the beam or body member or due to compressible support pads arranged at the middle and/or lower means. According to one embodiment the possibility for movement is provided by having flexible parts in the upper means themselves.

At use said middle means will engage the user's trunk part and in order to make it possible to use the device in a comfortable way without the disadvantage of having a too close and thus unpleasant contact with face or back of the head or neck, said middle means is arranged in such a way that its contact surface lies substantially outside the imagined line passing between the upper and the lower means. Hereby the upper means and in any case the upper part of the beam or body member itself will be at such a distance from the body that the device will not give an unpleasant feeling even to persons with a large body. In an especially preferred embodiment of the device according to the invention this is accomplished so that the middle part of the beam or body member itself it formed as a central support surface for contacting the trunk, the beam or body member then preferably having an arcuate form.

The lower part of the user's leg is intended in this connection to mean in the first place the shin-bone starting from the hollow angle at the ankle and ending with the hollow of the knee. Depending on whether the device is placed at the abdominal or the back side the lowest means for transferring a force will have its lowest position at the hollow angle portion above the heel and its highest position at the hollow of the knee, or its lowest position just above the foot blade and its lowest position at the hollow portion below the kneecap, respectively. The trunk part is intended to mean the user's trunk, starting with the sit muscle and ending with the torso. Normally, said middle means engages the pit of the stomach or the small of the back, respectively. The upper part of the body, again, indicates the region from the torso upwards towards the shoulders and the arms are also counted to this region e.g. when said means comprises regular handles. In this connection it should, however, be observed that the strength in the user's hands is generally not sufficient to provide an optimal gymnastic movement or a desired bending of the beam of the device by gripping with the hands at said upper means.

The functional principle of the present invention can in its most simple form be concluded as follows: The body is splinted to an elongated beam or body member which either bends when the body bends or resists said bending and thus provides a resistance when the user tries. to bend his body. The resistance to said bending is suitably adjustable in accordance with the user's strength and need of exercise. In case the resistance to bending exceeds the user's strength, an isometric gymnastic movement is provided while a small resistance provides a device for moving gymnastics.

Theoretically the idea of the present invention thus essentially comprises the feature that the upper and lower parts of the body, at a bending around the waist, should be attached to each respective part of the beam or body member, between which beam or body member parts should act a force which resists a mutual variation in the positions of said beam parts. In practice this is achieved by suitably forming the beam or body member part functionally as one single piece having a suitable resistance to bending. This is preferably performed with the aid of adjusting means which will be later described. Since a rigid attachment of said beam or body member part to the user's body is both complicated and unpleasant, the invention is in practice suitably embodied in such a way that it consists of a rod-like means with two actual attachment means and between them a contact point which presses against the user's trunk part. Alternatively the beam or body member may also be produced in two or more parts having between themselves a spring means for providing the desired flexibility. According to one embodiment of the invention the device can also be disassembled and/or collapsed in order to facilitate storing away or packing for a journey.

In practice the "splinting" will be accomplished in a variety of ways according to the invention. In order to provide suitable exercise, the number of points where the "splint" engages the body of the user should, however, generally be at least three, i.e. one at the lower part of the legs for locking of the beam or body member, one for engaging or supporting the user's back or stomach and one where the user causes exertion of a force with the aid of the upper part of his body.

Said lower means is suitably a crossbar which preferably is slidably attached along the lowest part of a central beam or body member and which is supported against the legs. Alternatively, the lower means may also consist of straps or the like, pulling elements. The middle means is in turn arranged for engaging against the user's back or stomach. This means, which is suitably somewhat widened in order to feel more comfortable, preferably consists of a crossbar or pad slidably arranged along the central middle part of the beam or body member. In use a pressure between the central beam or body member and the user's stomach or back will act on the middle means. All of said means are suitably padded or made soft in some other way for the sake of comfort.

The upper means in turn consists of a crossbar or the like which preferably is adjustable along the height of the beam or body member and suitably being provided with straps or the like. In use the straps are put around the user's shoulders or behind the back. In principle the said means could also comprise gripping handles, but the mere hand force is generally not sufficient for effective gymnastics. An alternative solution, on the other hand comprises yoke loops or the like which can be folded out so that they can run in the armpit and can be brought into engagement behind the arms or shoulders.

In a preferred simple embodiment of the invention the beam or body member comprises a central, somewhat bendable beam rod provided with crossbars which slide there along and which have an arcuate cross section. In said crossbars there are opposite openings wherein said central beam rod slides. The arcuate crossbars are somewhat elastic in their arcuate cross section so that they normally strive to obtain a position wherein the size or position of the openings does not exactly correspond with the cross section of the beam rod. Because of the friction between the beam and the openings said crossbars will be normally be locked to said beam rod but they can be displaced along said beam rod e.g. by pressing or pulling the cross section so that the cross sections of the openings substantially coincides with the cross section of the beam rod.

Figure 2:
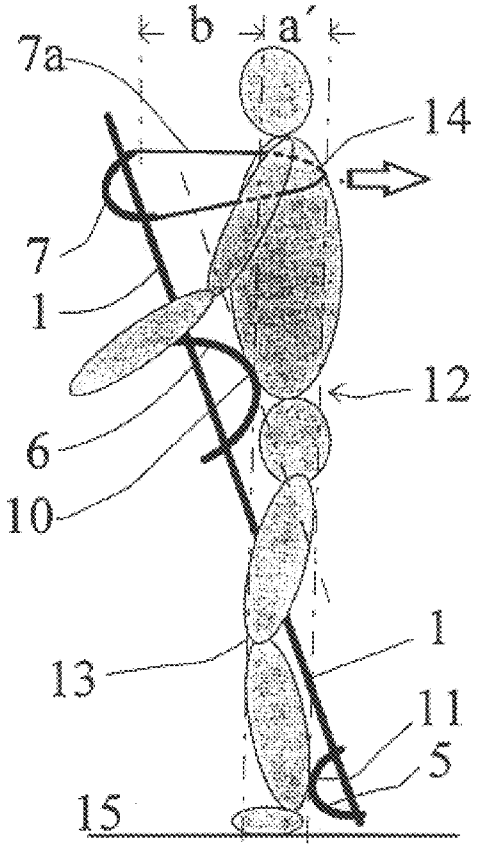
Figure 3:
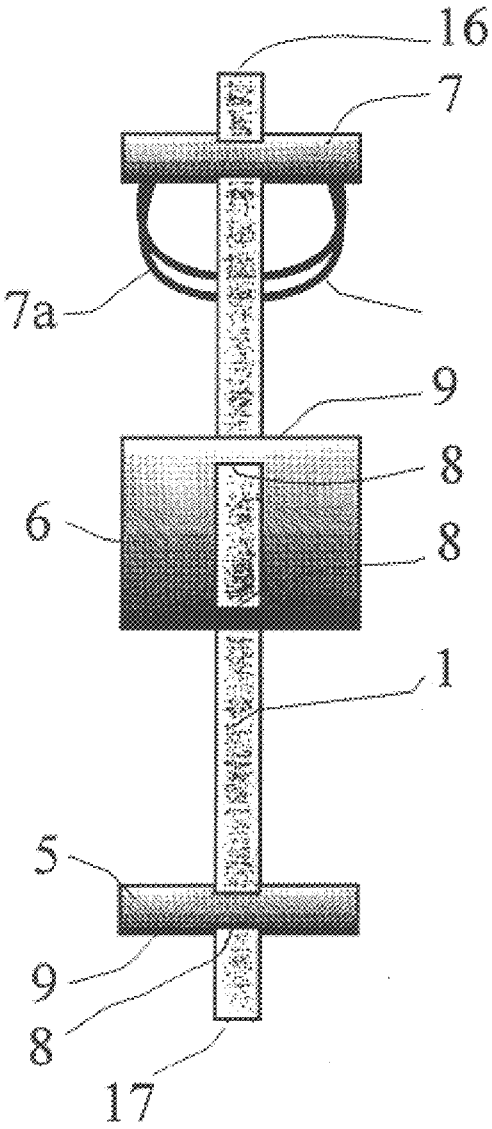
Figure 4:
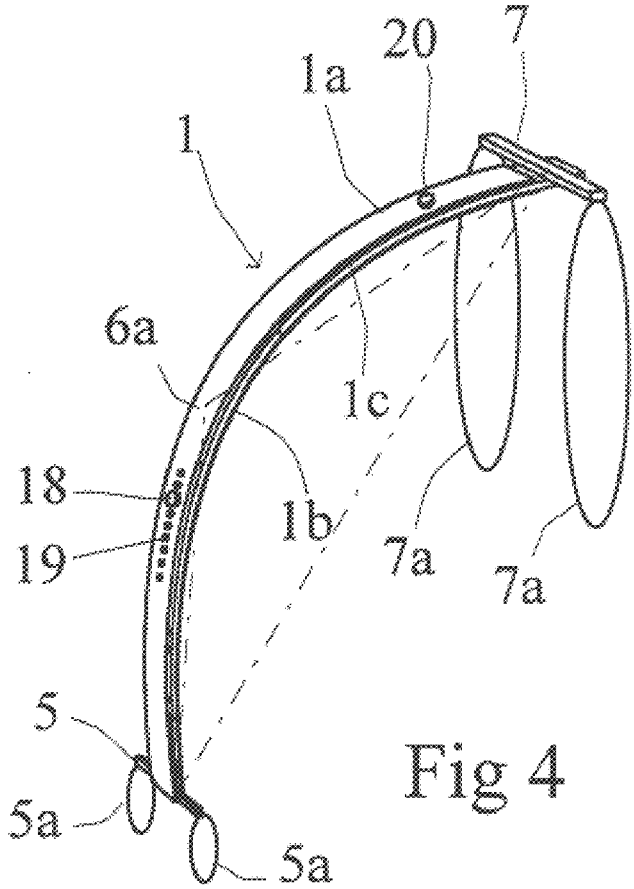

In the following the invention will be described in greater detail with reference to some embodiments which are especially disclosed in the appended drawings, wherein FIG. 1 schematically shows a preferred embodiment of the invention arranged in a position which is especially suitable for exercising the abdominal musculature, FIG. 2 schematically shows the embodiment according to FIG. 1 arranged in a position which is especially suitable for exercising the back musculature, FIG. 3 shows a front view of a concrete embodiment of the device according to FIGS. 1 and 2, and FIG. 4 shows a perspective view of alternative embodiment of the invention.

Referring especially to FIG. 1 the device suitably comprises a central beam or body member 1, the length of which corresponds to at least the distance between the user's 2 ankle 3 and neck 4. The central beam or body member 1 may be formed as an essentially straight rod, as is shown in FIGS. 1 to 3, but it may also be formed as an arcuate rod (see FIG. 4) or as a frame construction extending on both sides of the user. The last mentioned embodiment is especially useful for users which are very fat.

At said beam or body member 1 there are provided three means 5, 6, 7 and 7*a* for transferring force between said beam or body member 1 and the user 2. In the embodiment disclosed in FIGS. 1 to 3 said means 5, 6, 7 are formed as crossbars, the cross sections of which preferably are hemispherical, so that each bar, respectively, forms a half-round somewhat elastic "chute" having openings 8 through which the beam rod 1 runs. During exercise said crossbars 5, 6 and 7 are normally locked in their respective positions at said beam or body member 1, due to the fact that the elastic cross sections press said holes 8 into a distorted position with respect to the extension of said rod 1. By compressing the edges 9 or reach respective crossbar 5, 6, 7 said crossbars may be deformed whereby the openings of said holes 8 completely coincide with the cross section of said beam rod 1 whereby said crossbars may be freely displaced along said beam rod 1. The crossbars are suitably all padded in order to be pleasant at contact with the body.

According to the invention said means 5, 6, 7 should be located, before use, along the extent of said beam rod 1 in such a way that the lower means 5 will rest substantially against the shin-bone or the calf (see FIGS. 1 and 2, respectively), below the knee 13 and above the ankle 3. The upper means 7 will rest at a height corresponding to the user's shoulders 14. The middle means 6 has a contact surface 10 and said means 6 should be adapted along the beam rod 1 in such a way that said contact surface 10 will rest at the small of the back 12 (when exercising the abdominal musculature, see FIG. 1) or at the stomach pit (when exercising the back musculature, see FIG. 2).

In the embodiment shown in FIGS. 1 to 3 there is a harness 7*a* attached to the upper crossbar 7. Said harness 7*a* suitably comprises a double construction so that it can be pulled from the crossbar 7 round each respective shoulder and armpit (see FIG. 1) during exercise of the abdominal muscles and correspondingly behind the back 14 (see FIG. 2) during exercise of the back. The ends 16, 17 of the beam 1 are suitably provided with stoppers, on one hand, for retaining said means 5 and 7, and on the other hand with loops at the upper end 16 for hanging up the device when it is not in use. The lower end 17 may in certain cases suitably be provided with a loop for attaching to the floor 15 or the like.

For the user's comfort and safety it is important that a certain distance "b" is retained between the user's face and the beam or body member 1. This is achieved by arranging said middle means somewhat protruding so that the three means form a triangle (which in FIG. 2 may be seen as points 10-11-7 and which in FIG. 4 is shown with the dotted line 5-6*a*-7). The middle means 6 is thus arranged in such a way that its contact surface will lie at a distance "a" from the imagined line which runs between means 5 and means 7. On the other hand a triangle (10-11-14) is also formed between the points 10, 14, where the force acts. In this respect the contact surface 11 of the middle means suitably is at a distance a from the imagined joining line between points 10 and 14.

When the device is used for abdominal exercise (FIG. 1) it is placed essentially behind the back and rests with the contact surfaces 11 of the lower means 5 against the ankles 3 or the shin-bone. The middle means 6 will then rest against the small of the back 12. When the user now bends forwards (see the arrow) he will at the same time pull the harness 7*a* with the upper part of his body. The beam rod 1 which is supported at the two points 10 and 11 resists a free forward movement of the harness 7*a* with a force which is directed in the opposite direction. A counter force now exists and can be used as a gymnastic pressure for the abdominal muscles which strive to bend the body. The magnitude of the counter force and the freedom of movement of the harness 7*a* can be adjusted to suitable values according to the user and the type of exercise by varying the bending or compression parameters of the beam rod 1 and/or the means 5, 6, 7 or by adjusting the elongation of the harness 7*a*. A rod which is in practice unbendable and having solid crossbars 5, 6, 7 will give a high counter force under isometric conditions. An elastic rod 1 or more flexible means 5, 6, 7 or easily elongated straps in the harness 7*a* will, on the other hand, give a lower counter force but allow a long bending movement.

Since the contact surface 10 of said means 6 of said beam rod 1 engages the small of the back 12, neither the back nor the abdominal muscles can be overtaxed by unsuitable movements or by a tensing of the wrong groups of muscles in an unnatural load situation. The spin cannot either be subjected to a harmful tensing because of the exercise. Thus, the abdominal musculature of the user can be exercised under optimal conditions, in an upright position and without a risk of excessive extraction and the like. When exercising the back (see FIG. 2) the device is correspondingly placed at the abdominal side of the user with the harness 7*a* suitably placed behind the back 14.

FIG. 3 shows a front view of the embodiment of the device which has been described in connection with FIGS. 1 and 2. In principle, the beam rod 1 may be of an arbitrary material having the desired characteristics. Thus the beam may, for instance be made of thick veneer, metal, plastic reinforced with glass or carbon fibers, or some other synthetic material. In order to provide an adjustable flexibility the beam may be made of thinner laminae 1*a*, 1*b*, 1*c* (see especially FIG. 4) which run in parallel and which can be locally locked to each other in order to provide a greater rigidity. Said locking can easily be provided by introducing pins 18 in holes 19 passing through several laminae, as is more closely shown in FIG. 4.

FIG. 4 shows an alternative embodiment of the present invention. In this embodiment the function of the middle means 6 is substituted by having the beam rod 1 itself of an arcuate form so that the middle part 6*a* of the beam engages the user's trunk. The rod 1 is in this region suitably provided with padding for comfort and in this region it may also be wider than in the other areas. FIG. 4 shows an embodiment utilizing two parallel laminae 1*a* and 1*b*, and an upper cross bar 7 is preferably arranged at a third lamina 1*c*, which may be locked in a desired position with respect to the laminae 1*a* and 1*b* with the aid of pin 20.

FIG. 4 also shows that the lower means for the exertion of the force as such may comprise straps 5*a* which are applied over the foot so that they take support from the ankles through a pulling force (in contrast to the embodiment according to FIG. 4, wherein the lower means 5 are placed behind the legs and exert a pressure). It is, in fact, not critical what kind of technical construction supports 5, 5*a*, 7, 7*a*, respectively, have. It is, however, important that the middle means 6, 6*a* can take support from the user's 2 waist region, and that the whole of the lower part of the device cannot functionally twist when the user exerts a force against the upper means 7, 71 by his bending at the waist.

In all the illustrated embodiments the beam 1 has consisted of one single elongated element. According to a modification of the present invention the body member may, as such, also be comprised of two parallel pieces which either may be attached to each other in a Y-form or which may be attached to each other, for instance, via cross bars. A variant of the present device may comprise a substantially annular frame having a cross bar. The actual flexibility of the device can also be provided by utilizing a spring-loaded joint which is suitably adjustable.

The description above has disclosed some typical embodiments but it is obvious for a person skilled in the art that the invention can be varied also in many other ways within the scope of the claims.

What is claimed is:

1. A gymnastic apparatus for simultaneously exercising the back and abdominal muscles of a user, the apparatus comprising:

i) an elongate beam comprising an upper portion, a middle portion and a lower portion;

ii) upper means connected to the upper portion for engaging the upper body of the user with the user in an upright position such that, with the upper means engaged with the upper body of the user in said upright position, the upper portion of the beam is disposed at a shoulder level of the user, the middle portion of the beam is disposed at a trunk level of the user and the lower portion of the beam is disposed at a lower level of the user, the beam having a flexibility that allows it to flex when the user bends and exerts a pulling force on the upper portion with the beam providing resistance against the pulling force;

iii) middle means connected to the beam for engaging a trunk portion of the user with the upper means engaged with the upper body of the user such that, when the user bends and the upper body of the user exerts a pulling force against the upper portion of the beam, the middle means contacts and supports a trunk portion of the user; and iv) lower means connected to the lower portion of the beam for engaging a lower portion of a leg of the user to restrict movement of the lower portion of the beam when the user bends and the upper body of the user exerts a pulling force against the upper portion of the beam.

2. The apparatus of claim 1 further including middle means connected to the beam intermediate the upper and lower means for transferring force from beam to a user's trunk.

3. The apparatus of claim 1 wherein the lower means includes a lower crossbar.

4. The apparatus of claim 1 wherein the lower crossbar is adjustably mounted on the beam.

5. The apparatus of claim 3 wherein the lower crossbar is slidably mounted for longitudinal movement on the beam.

6. The apparatus of claim 5 wherein the lower crossbar is arcuate shaped in cross section and includes at least one aperture through which the beam may be inserted.

7. The apparatus of claim 2 wherein the middle means includes a pad adjustably mounted on the beam.

8. The apparatus of claim 7 wherein the pad is slidably mounted for longitudinal movement on the beam.

9. The apparatus of claim 2 wherein the pad is arcuate shaped in cross section and includes at least one aperture through which the beam may be inserted.

10. The apparatus of claim 1 wherein the upper means includes an upper crossbar.

11. The apparatus of claim 10 wherein the upper crossbar is adjustably mounted on the beam.

12. The apparatus of claim 10 wherein the upper crossbar is slidably mounted on the beam.

13. The apparatus of claim 12 wherein the upper crossbar is arcuate shaped in cross section and includes at least one aperture through which the beam may be inserted.

14. The apparatus of claim 1 wherein the upper means further includes at least one shoulder strap.

15. The apparatus of claim 10 further including at least one shoulder strap which is connected to the upper crossbar.

16. The apparatus of claim 1 wherein the lower means includes at least one ankle strap.

17. The apparatus of claim 3 further including at least one ankle strap connected to the lower crossbar.

18. The apparatus of claim 1 wherein the beam is arcuate in shape when viewed from the side.

19. The apparatus of claim 18 further including means for adjusting the flexibility in bending of the beam.

20. The apparatus of claim 19 wherein the beam includes at least two laminae, each lamina having a fixed end at which the laminae are joined, and means spaced, from the fixed ends for limiting the relative movement of the laminae.

21. The apparatus of claim 20 wherein the laminae include a plurality of alignable apertures and wherein the means for limiting includes a pin insertable through the apertures.

22. A gymnastic apparatus for simultaneously exercising the back and abdominal muscles comprising:

an elongated beam;

a lower crossbar slidably mounted on the beam for transferring force from the beam to the lower part of a user's legs;

an upper crossbar slidably mounted on the beam and at least one shoulder strap connected to the crossbar for transferring force from a user's shoulders to the beam;

a pad slidably mounted to the beam intermediate the upper and lower crossbars for transferring force from the beam to the user's trunk;

the upper and lower crossbars and the pad each being arcuate shaped in cross section and each including at least one aperture through which the beam may be passed.

23. A gymnastic apparatus for simultaneously exercising the back and abdominal muscles comprising:

an elongated beam of laminated construction having an arcuate shape when viewed from the side;

a lower crossbar mounted on the beam and at least one ankle strap connected to the lower crossbar for transferring force from the beam to the lower part of a user's legs;

an upper crossbar slidably mounted on the beam and at least one shoulder strap connected to the crossbar for transferring force from a user's shoulders to the beam; and, means for adjusting the flexibility of the beam in bending including means for limiting relative movement of adjacent laminae.

24. A gymnastic apparatus for simultaneously exercising the back and abdominal muscles of a user, the apparatus comprising:

i) an elongate beam that is arcuate in shape, said beam comprising an upper portion, a middle portion and a lower portion, ii) upper means connected to the upper portion for engaging the upper body of the user with the user in an upright position such that, with the upper means engaged with the upper body of the user in said upright position, the upper portion of the beam is disposed at a shoulder level of the user, the middle portion of the beam is disposed at a trunk level of the user and the lower portion of the beam is disposed at a lower level of the user the beam having a flexibility that allows it to flex when the user bends and exerts a pulling force on the upper portion with the beam providing resistance against the pulling force, said middle portion contacting and supporting a trunk portion of the user when the user bends and exerts said pulling force on the upper portion of the beam with the upper means engaged with the upper body of the user; and iii) lower means connected to the lower portion of the beam for engaging a lower portion of a leg of the user and for exerting a pulling force on the leg of the user that restricts movement of the lower portion of the beam when the user bends and the upper body of the user exerts a pulling force against the upper portion of the beam.

* * * * *